US008985184B2

(12) United States Patent
Schwickal et al.

(10) Patent No.: US 8,985,184 B2
(45) Date of Patent: Mar. 24, 2015

(54) METHOD FOR REGENERATING THE SAND OF SAND MOLDS AND SAND CORES

(71) Applicant: Bayerische Motoren Werke Aktiengesellschaft, Munich (DE)

(72) Inventors: Harald Schwickal, Feldkirchen (DE); Matthias Huebner, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/188,377

(22) Filed: Feb. 24, 2014

(65) Prior Publication Data

US 2014/0166226 A1 Jun. 19, 2014

Related U.S. Application Data

(63) Continuation of application No. PCT/EP2012/003585, filed on Aug. 24, 2012.

(30) Foreign Application Priority Data

Aug. 25, 2011 (DE) ..... 10 2011 081 530

(51) Int. Cl.
*B22C 5/18* (2006.01)
*B22C 5/04* (2006.01)
*B22C 5/08* (2006.01)

(52) U.S. Cl.
CPC ... *B22C 5/18* (2013.01); *B22C 5/04* (2013.01); *B22C 5/08* (2013.01)
USPC ..... 164/5

(58) Field of Classification Search
CPC ..... B22C 5/04; B22C 5/08; B22C 5/18
USPC ..... 164/5
See application file for complete search history.

(56) References Cited

U.S. PATENT DOCUMENTS

| | | | | |
|---|---|---|---|---|
| 4,685,973 | A | 8/1987 | Ashton | |
| 5,045,090 | A | 9/1991 | Pohl | |
| 5,279,741 | A | 1/1994 | Schott | |
| 2003/0111202 | A1 * | 6/2003 | Sparks et al. | 164/4.1 |
| 2010/0173767 | A1 | 7/2010 | Koch et al. | |
| 2010/0252951 | A1 * | 10/2010 | Ina | 264/219 |

FOREIGN PATENT DOCUMENTS

| | | | |
|---|---|---|---|
| CN | 1481950 | A | 3/2004 |
| CN | 1792497 | A | 6/2006 |

(Continued)

OTHER PUBLICATIONS

International Search Report dated Dec. 6, 2012 w/ English translation (four (4) pages).

(Continued)

*Primary Examiner* — Kevin E Yoon
(74) *Attorney, Agent, or Firm* — Crowell & Moring LLP

(57) ABSTRACT

For regenerating the sand, which is obtained from sand molds and/or sand cores, which are produced from the sand and soluble glass as a binder and are used in metal casting, the sand obtained from the sand molds and/or sand cores is subjected to a mechanical regeneration stage and a thermal regeneration stage. During or after the mechanical regeneration stage, the obtained sand is mixed with a hardener for soluble glass.

19 Claims, 1 Drawing Sheet

(56) References Cited

FOREIGN PATENT DOCUMENTS

| | | | |
|---|---|---|---|
| CN | 101780521 | A | 7/2010 |
| CN | 101869965 | A | 10/2010 |
| CN | 102000764 | A | 4/2011 |
| CN | 102078915 | A | 6/2011 |
| DE | 1 806 842 | A1 | 5/1970 |
| DE | 41 11 643 | A1 | 10/1991 |
| DE | 41 90 731 | C1 | 2/1993 |
| DE | 43 06 007 | A1 | 9/1994 |
| DE | 44 34 115 | C1 | 11/1995 |
| DE | 100 38 419 | A1 | 2/2002 |
| DE | 10 2007 008 149 | A1 | 8/2008 |
| JP | 8-108244 | A | 4/1996 |

OTHER PUBLICATIONS

German Search Report dated Jan. 10, 2012 w/ partial English translation (ten (10) pages).

English-language Chinese Office Action dated Dec. 5, 2014 (Nine (9) pages).

* cited by examiner

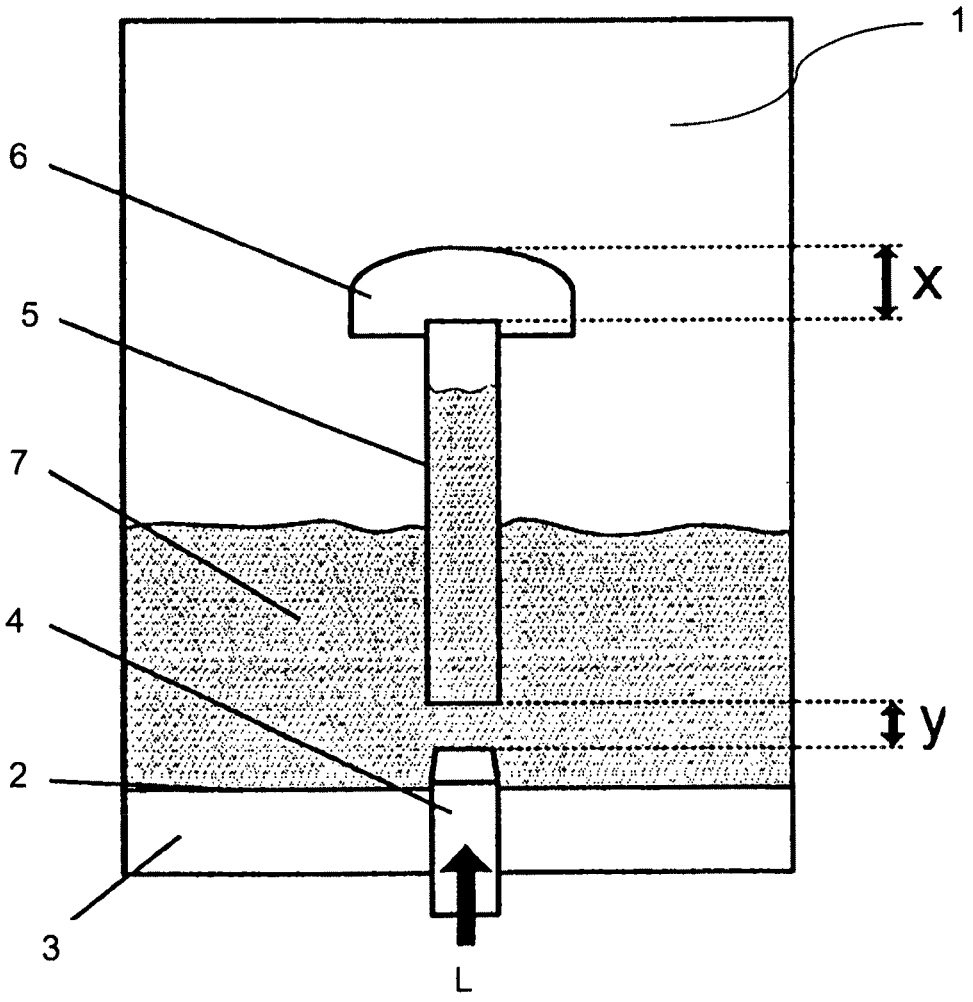
1
6
5
7
4
2
3
x
y
L

METHOD FOR REGENERATING THE SAND OF SAND MOLDS AND SAND CORES

CROSS REFERENCE TO RELATED APPLICATIONS

This application is a continuation of PCT International Application No. PCT/EP2012/003585, filed Aug. 24, 2012, which claims priority under 35 U.S.C. §119 from German Patent Application No. DE 10 2011 081 530.9, filed Aug. 25, 2011, the entire disclosures of which are expressly incorporated by reference herein.

BACKGROUND AND SUMMARY OF THE INVENTION

The invention relates to a method of regenerating sand regained from sand molds and/or sand cores which are produced from the sand and an inorganic binder, for example, soluble glass, and are used in metal casting.

In metal casting, sand cores solidified by means of a soluble glass binder are used, for example, for forming cavities. For this purpose, large quantities of sand are required, for example, for the series production of automobiles.

Particularly for reasons of cost and environmental protection, used sand, i.e. sand regained from sand cores, is used for the sand core production instead of new sand.

A thermal regeneration is sufficient in the case of a use of used sand bound by means of an organic binder. In the case of used sand bound by means of inorganic binders, a thermal regeneration will not be sufficient. Here, the regeneration usually takes place in two stages in a first mechanical and a second thermal regeneration stage. During the mechanical regeneration, a large fraction of the inorganic binder is removed from the surface of the sand grains. However, chemically active remnants of inorganic binder remain. These chemically active binder remnants are melted during the thermal regeneration, envelop the sand grains with a thin layer, subsequently cool down again and are thereby largely thermally deactivated. The regenerated used sand is then recycled. After the regeneration of the used sand, a percentage of new sand will be added.

By means of the regeneration, binder remnants are removed from the used sand. A binder remnant present in the used sand will have an effect on the sand core and sand mold production. As a result, the processing characteristics of the molding material, thus, of the mixture of sand and soluble glass binder, can, for example, change the flowability of the molding material and the setting rate. In addition, the firmness of the sand core and of the sand mold may be impaired by binder remnants in the used sand.

However, by means of the regeneration of the sand by a mechanical and a thermal regeneration stage, the binder remnants on the surface of the sand grains are only incompletely removed. This context is becoming more significant in the case of a closed material cycle with multiple regenerations of the used sand because a multiple regeneration of the used sand results in a corresponding accumulation of binder remnants.

It is an object of the invention to improve the regeneration of the used sand, which is obtained from sand cores or molds solidified by use of inorganic binders, such that the binder in the used sand is eliminated as completely as possible or a remaining remnant of the binder is at least chemically deactivated.

According to the invention, this and other objects are achieved by a method of regenerating sand obtained from sand molds and/or sand cores which are produced from the sand and soluble glass as a binder and are used in metal casting. The obtained said is subjected to a mechanical regeneration stage and a thermal regeneration stage and is returned in a cycle to the sand mold and/or sand core production. The sand is mixed with a hardener for soluble glass during the mechanical regeneration stage or after the mechanical and before the thermal regeneration stage.

According to the invention, the used sand, thus the sand obtained from the sand molds and/or sand cores, is grain-singled in the next mechanical regeneration stage, for example, by use of a crusher. Subsequently, the binder can be removed by rubbing the sand grains against one another, for example, by way of a mechanical-pneumatic treatment.

After the mechanical regeneration stage, a binder remnant remains in the used sand. This binder remnant consists of an active fraction, which dissolves under sand core or sand mold production conditions, and of an inactive fraction, which is insoluble under sand core or sand mold production conditions. While the active fraction impairs the processing characteristics of the molding material and the firmness of the sand core or of the sand mold, the inactive fraction has no influence on the processing characteristics of the molding material as well as the firmness of the sand core and of the sand mold.

In order to eliminate the active binder fraction, according to the invention, the grain-singled sand is mixed during or after the mechanical regeneration stage with a hardener for soluble glass, whereupon it is subjected to a thermal reaction step.

An agent for the cross-linkage or polymerization of the silicate ions of the active binder fraction is used as a hardener. The deactivation is to be caused by the cross-linkage and the resulting complete hardening of the used soluble glass binder system. This means that, for the regeneration of the sand, by use of an additional process step, a hardener for soluble glass is added, which leads to a largely completely chemical deactivation of the active alkaline binder remnants on the sand grain surface. This chemical deactivation takes place by a precipitation reaction of the soluble glass to silicic acid, in any case, to insoluble polysilicates, or corresponding to the used hardener, also to other reaction products, for example, zeolites.

The hardener may be an inorganic or organic acid or a salt. The inorganic acid may be a mineral acid, for example, hydrochloric acid or phosphoric acid, or carbon dioxide. As the organic acid, a mono-, di- or polycarboxylic acid can be used, such as citric acid or ethanoic acid. The salt may be an aluminate, for example, sodium aluminate; a sulfate, for example, aluminum sulfate; a phosphate, for example, aluminum phosphate; or a fluorosilicate, for example, fluorohexasilicate. It should be possible to use the hardener risk-free in an automated process. Furthermore, reaction products occurring during the deactivation of the active binder fraction should have no negative influence on the sand quality or the binder reaction when regenerated sand is used. The precipitation products should therefore preferably burn up in the thermal regeneration stage and no longer be contained in the salt.

The hardener can preferably be used as an aqueous solution. The addition of the hardener must not result in a clumping of the dry sand in the regeneration. Preferably, a fine wetting of the sand grain surfaces takes place by use of a solution of the hardener.

The sand mixed with the hardener is preferably moved in a fluid bed during the hardening reaction. As an alternative, a mixer can also be used. The hardening reaction can therefore take place during a defined reaction time. By use of the fluid bed, the sand can be moved along into a reaction chamber, in which the thermal reaction step is carried out. Instead of in a fluid bed, the sand can also be conveyed by way of a mechanical device, such as a screw conveyor.

The sand mixed with the hardener may also be intermediately stored before the thermal reaction step. For this purpose, a conveying of the sand takes place in an intermediate container and finally the thermal regeneration stage.

In the thermal regeneration stage, the deactivation of the binder, thus the hardening of the active binder to form an inactive binder, is completed.

For this purpose, the sand is heated to a temperature of preferably at least 200° C., particularly at least 500° C. The thermal regeneration stage can be carried out by way of a flame in order to deactivate the soluble glass remnants on the sand grains. However, the thermal regeneration stage can also be carried out in a fluid bed furnace to which the sand mixed with the hardener is fed.

In an advantageous embodiment of the invention, the mechanical regeneration stage comprises the following steps:

a) grain singling by the effect of mechanical crushers on the sand;

b) transferring the grain-singled sand into a pneumatic treatment chamber and moving the sand in the pneumatic treatment chamber in a fluid bed formed of air and sand; and c) accelerating the sand in the pneumatic treatment chamber so that the singled sand grains rub against one another and the binder is at least partially removed from a grain surface.

As a result of the acceleration of the sand grains against the impact body, a particularly intensive load upon the grain surfaces of the sand grains, particularly an especially intensive rubbing of the sand grains against one another, can be achieved. It is thereby achieved that a large fraction of the binder remnants adhering to the grain surfaces is mechanically removed. The dissolved binder can then, for example, be removed together with a dust fraction from the pneumatic treatment chamber.

Advantageously, the hardener is added to blast air used for accelerating the sand. This permits a particularly rapid and intensive mixing of the hardener with the sand. However, it is also contemplated to add the hardener to the air used for producing the fluid bed.

According to a further development of the invention, the hardener will be added to the air and/or the blast air only after are predefined first treatment duration of the sand in the pneumatic treatment chamber. The first treatment duration is, for example, about 20 to 40 minutes, preferably about 25 to 35 minutes, counted from the start of the acceleration of the sand against the impact body. It was found that, after such a first treatment duration, a significant fraction of the binder adhering to the grain surfaces of the sand has been mechanically removed. Even in the case of longer treatment durations, the fraction of mechanically removable binder remnants will hardly increase. In order to keep the amount of hardener as low as possible, advantageously, the hardener will be used only when hardly any more binder remnants can be removed from the grain surfaces by the mechanical effect alone.

According to a particularly advantageous further development, liquid, particularly an aqueous hardener, is used. The liquid hardener is advantageously added in atomized form to the blast air and/or to the air. The atomization can take place in that the liquid hardener is atomized by use of a jet or an ultrasonic atomizer and is added to the blast air and/or to the air.

According to a further advantageous embodiment of the invention, new sand is added to the fluid bed after a predefined second treatment duration. The term "new sand" applies to sand which has previously not been mixed with a binder and used for producing sand cores or sand molds. The second treatment duration is advantageously selected such that it is longer than the first treatment duration. The addition of new sand can take place, for example, 20 to 60 minutes, preferably 45 to 55 minutes, after the start of the acceleration of the sand against the impact body. The added quantity of new sand corresponds to approximately 5 to 15%, preferably 7 to 13% of the quantity of sand to be regenerated. The new sand is advantageously added only when the hardener has had contact for a sufficiently long reaction time with the binder remnants remaining on the grain surfaces. The reaction time between the hardener and the sand to be regenerated amounts to 10 to 35 minutes, advantageously 15 to 30 minutes.

According to a further advantageous embodiment, the sand is heated in the fluid bed to a temperature of from 40 to 60° C., preferably 45 to 55°. As a result, particularly the reaction rate between the hardener and binder remnants remaining on the grain surfaces can be increased.

After passing through the mechanical regeneration stage, the mechanically regenerated sand will be present in pourable form. It is immediately thermally regenerated in the pourable form, as required, after an intermediate storage. This means that the mechanically regenerated sand is, in particular, not mixed with water, subjected to attritor grinding, wet grinding or the like as well as subsequent drying. The suggested method can therefore be carried out relatively rapidly and easily, in particular, also continuously.

According to a further advantageous development, the mechanically regenerated sand mixed with the hardener is transferred for the thermal regeneration into a furnace and is moved there at a temperature in the range of from 550° to 700° C. in an additional fluid bed formed of gas and the mechanically regenerated sand. The gas advantageously is a flammable gas. This means that the mechanically regenerated sand can therefore be moved in a flame. By heating the mechanically regenerated sand to a temperature of, for example, in the range of from 600° C. to 650° C., the hardened binder remnants still adhering to the grain surfaces are finally completely deactivated. Furthermore, the remnants of hardener are removed.

For saving energy, the mechanically regenerated sand can be preheated before being transferred into the furnace. For this purpose, warm waste air can be used that is discharged from the furnace.

Other objects, advantages and novel features of the present invention will become apparent from the following detailed description of one or more preferred embodiments when considered in conjunction with the accompanying drawing.

BRIEF DESCRIPTION OF THE DRAWING

The single drawing is a schematic view of a pneumatic treatment chamber.

DETAILED DESCRIPTION OF THE DRAWING

A cleaning chamber 1 is separated by way of a jet floor 2 from a wind chamber 3. Reference number 4 indicates an air jet which projects into the cleaning chamber 1. At a distance—axially offset thereto—a tube 5, which leads into an impact bell 6, is connected to the air jet 4. A distance between a mouth of the air jet 4 and an inlet of the tube 5 is marked y. A further distance between an outlet of the tube 5 and an interior wall of the impact bell 6 has the reference symbol x. Sand received in the cleaning chamber 1 has the reference number 7. It is fluidized by air which is fed from the wind chamber 3 through the jet floor 2.

The sand or used sand, which is, for example, grain-singled by a crusher, is accelerated by the air jet 4 by way of blast air L fed under pressure and through the tube 5 onto the interior wall of the impact bell 6 and falls from there back into the cleaning chamber 1. A speed of the sand accelerated through the tube 5 is advantageously selected such that a damming-up and thereby a sand cushion is formed in the impact bell 6. As a result, a careful friction of the sand grains with respect to one another can be achieved. Particles of dust and binder remnants forming as a result of the friction of the sand grains are removed by way of suction (not shown) at the top side of the cleaning chamber 1.

After a first treatment duration of, for example, 30 minutes, citric acid in an atomized form (not shown here) is advantageously added to the blast air L. This may, for example be 50%-type citric acid. Advantageously, a quantity of 1 to 50 g, preferably 3 to 10 g, are added for each kilogram of sand. A reaction time between the hardener and the fluidized sand 7, for example, amounts to 10 to 30 minutes. Subsequently, 10% new sand is fed to the cleaning chamber 1. After a further treatment duration of 5 to 10 minutes, the thus produced mechanically regenerated sand is removed from the cleaning chamber 1 and fed to the thermal regeneration stage.

For this purpose, the mechanically regenerated sand is transferred into a fluid bed furnace and is moved there in an additional fluid bed at a treatment temperature of, for example, 600 to 650° C. in an additional fluid bed. In the process, binder remnants still remaining on the grain surfaces are thermally deactivated and possibly existing remnants are removed from the chemical deactivation. The result is a regenerated sand which almost has the characteristic of new sand.

By means of the method according to the invention, as a result of a complete deactivation of the soluble glass binder, a clearly improved and constant quality of the used sand, thus, of the sand obtained from the sand cores and/or sand molds, is achieved. This results in a more stable production process of the sand core and sand mold production and thereby in lower fault and rejection numbers. High-expenditures and personnel-intensive formula adaptations are not necessary in the sand core production.

As a result of the chemical deactivation of the binder with the hardener, the process time for the thermal regeneration of the sand can also be reduced. In addition, the process temperature of the thermal regeneration stage can be reduced. The throughput of the used sand and a reduction of the operating costs can thereby be achieved.

Furthermore, a reduction of the new-sand fraction can be achieved by the deactivation of the active residual binder fraction. The maximal number of revolutions and the useful life of the sand is increased, and the necessary quantity of new sand is reduced.

In this case, the measure according to the invention of mixing the sand between the mechanical and thermal regeneration stage with a hardener for soluble glass is of essential significance.

While, without this measure, the fraction of the active residual binder, in the case of a new-sand addition of, for example, 10% by weight per used-sand revolution, by means of the same facility and under otherwise identical conditions, is already increased after, for example, a five-time revolution of the used sand, such that a noticeable effect on the processing characteristics of the molding material occurs, by mixing the sand with hardener, the number of revolutions is correspondingly increased or the required quantity of new sand is correspondingly reduced.

LIST OF REFERENCE SYMBOLS

1 Cleaning chamber
2 Jet floor
3 Wall chamber
4 Air jet
5 Tube
6 Impact bell
7 Fluidized sand
L Blast air
x second distance
y first distance The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of regenerating sand obtained from at least one of sand molds and sand cores produced from sand and soluble glass as a binder, the method comprising the acts of:

subjecting the obtained sand to a mechanical regeneration stage and a thermal regeneration stage before returning the obtained sand to at least one of sand mold and sand core production; and mixing the obtained sand with a hardener for soluble glass either during the mechanical regeneration stage or after the mechanical regeneration stage but before the thermal regeneration stage.

2. The method according to claim 1, wherein the hardener is used as an aqueous solution.

3. The method according to claim 2, further comprising the act of:

moving the obtained sand mixed with the hardener during a hardening reaction in a fluid bed or via a mixer.

4. The method according to claim 1, wherein the obtained sand mixed with the hardener is intermediately stored before the thermal regeneration stage.

5. The method according to claim 1, wherein the hardener for the soluble glass is an inorganic acid, an organic acid, or a salt.

6. The method according to claim 5, wherein the inorganic acid is a mineral acid.

7. The method according to claim 5, wherein the organic acid is a mono-, di-, or polycarboxylic acid.

8. The method according to claim 5, wherein the salt is an aluminate, a phosphate, or fluorosilicate.

9. The method according to claim 1, wherein the mechanical regeneration stage comprises the acts of:

grain-singling, via an effect of mechanical crushers on the obtained sand;

transferring the grain-singled sand into a pneumatic treatment chamber and moving the sand in the pneumatic treatment chamber in a fluid bed formed of air and sand; and accelerating the sand in the pneumatic treatment chamber against an impact body so that singled sand grains rub against one another and the binder is at least partially removed from a grain surface.

10. The method according to claim 9, wherein the hardener is added to at least one of:

a blast air used for accelerating the sand and air used for producing the fluid bed.

11. The method according to claim 10, wherein the hardener is added only after a predefined first treatment duration of the sand in the pneumatic treatment chamber.

12. The method according to claim 10, wherein the hardener is a liquid hardener added in atomized form.

13. The method according to claim 11, wherein new sand is added to the fluid bed after a predefined second treatment duration.

14. The method according to claim 13, wherein an added quantity of new sand corresponds to approximately 5 to 15% of an amount of sand to be regenerated.

15. The method according to claim 14, wherein the sand is heated in the fluid bed to a temperature of from 40 to 60° C.

16. The method according to claim 14, wherein the sand is heated in the fluid bed to a temperature of from 45 to 55° C.

17. The method according to claim 1, wherein mechanically regenerated sand mixed with the hardener is immediately thermally regenerated in pourable form.

18. The method according to claim 1, wherein mechanically regenerated sand is transferred for the thermal regeneration stage into a furnace and is moved in the furnace at a temperature in a range of from 550° C. to 700° C. in an additional fluid bed formed of gas and the mechanically regenerated sand.

19. The method according to claim 18, wherein the mechanically regenerated sand is preheated before being transferred into the furnace.

* * * * *